US005358414A

United States Patent [19]

Kish et al.

[11] Patent Number: 5,358,414

[45] Date of Patent: Oct. 25, 1994

[54] MULTI-TERMINAL ELECTRICAL CONNECTORS

[75] Inventors: Paul P. Kish, St-Lazarf; Joseph Maroun, St. Laurent, both of Canada

[73] Assignee: Northern Telecom Limited, Montreal, Canada

[21] Appl. No.: 141,360

[22] Filed: Oct. 28, 1993

Related U.S. Application Data

[62] Division of Ser. No. 940,279, Sep. 3, 1992, Pat. No. 5,282,754.

[51] Int. Cl.[5] ..... H01R 23/02

[52] U.S. Cl. ..... 439/108; 439/894

[58] Field of Search ..... 439/676, 108, 654, 92, 439/638, 723, 724, 894.1, 470, 459, 456, 894

[56] References Cited

U.S. PATENT DOCUMENTS

| | | | |
|---|---|---|---|
| 3,761,842 | 9/1973 | Gandrud | 439/894 |
| 5,186,647 | 2/1993 | Derkmann et al. | 439/894 |
| 5,244,415 | 9/1993 | Marsilio et al. | 439/456 |

FOREIGN PATENT DOCUMENTS

| | | | |
|---|---|---|---|
| 3216217 | 11/1983 | Fed. Rep. of Germany | 439/470 |

*Primary Examiner*—Gary F. Paumen

*Attorney, Agent, or Firm*—R. J. Austin

[57] ABSTRACT

A multi-terminal electrical connector having two rows of terminals on one side of a dielectric housing and two rows of terminals on the other side. On one side pairs of terminals are laterally spaced from row to row. Conductors extend through the connector to connect terminals of each pair on one side to terminals of an associated pair on the other side. In one structure, the conductors to alternating conductor pairs on each side are spaced apart laterally of the rows while for the other pairs, the conductors cross over each other. In another structure, the conductors of each of the pairs are spaced laterally and a spacer is provided to cause alternate pairs of untwisted wires to be spaced laterally and the wires of the other pairs to cross over each other. In both structures, the arrangement reduces crosstalk.

1 Claim, 3 Drawing Sheets

MULTI-TERMINAL ELECTRICAL CONNECTORS

This is a division of patent application Ser. No. 07/940,279, filed on Sep. 3, 1992 by Paul P. Kish, et al for "MULTI-TERMINAL ELECTRICAL CONNECTORS".

This invention relates to multi-terminal electrical connectors.

Multi-terminal electrical connectors are designed for high frequency transmission in the telecommunications industry. One type of connector has two spaced and parallel rows of terminals at a front side of a dielectric housing and two further spaced and parallel rows of terminals at a rear side of the housing. Conductors of the connector electrically connect the terminals of each row on the front side to the terminals of a specific row on the rear side, the conductors extending in laterally spaced relationship through the housing. In use of this type of connector, two conductors of a twisted insulated pair are connected one to each of two laterally spaced terminals these terminals being located one in each of the two rows at the rear side of the housing.

Cross-talk is a paramount problem in high frequency transmission and has a relationship to the pitch or lay length of a twisted pair of conductors. In other words, as the lay length is reduced, cross-talk between adjacent twisted pairs is also reduced. However, while cross-talk may be lessened by choice of lay length, the effect of this can be somewhat nullified in that cross-talk is permitted to increase when high frequency transmission takes place through the above-described type of multi-terminal connector. This increase is due to electromagnetic coupling inside the connector.

The present invention seeks to provide a multi-terminal electrical connector which in use reduces the above problem.

Accordingly, the present invention provides a multi-terminal electrical connector comprising: a dielectric housing means; a first row and a second row of terminals accessible at a front side of the housing means and a third row and a fourth row of terminals accessible at a rear side of the housing means with the two rows of terminals accessible at each side being laterally spaced with each terminal in one row associated with a laterally spaced terminal in the other row to provide a pair of terminals; and a plurality of pairs of electrical conductors extending through the housing means, each pair of conductors connecting an individual one of a pair of terminals on the front side of the housing means with an individual one of a pair of terminals on the rear side of the housing means, and the conductors of each pair in alternating conductor pairs are in spaced positions laterally of the rows of terminals to connect terminals in the first and second rows, respectively, with terminals in the third and fourth rows, while the conductors of each pair in the other conductor pairs cross over each other and laterally of the rows of terminals to connect terminals of the first and second rows, respectively, with terminals of the fourth and third rows.

The connector according to the invention defined above may be directly connected to conductor wires at the rear side of its housing means and be connectable at its front side to a mating connector within the scope of the invention. Alternatively, a connector of the invention may be provided as a coupling connector for in-series location between conventional multi-terminal connectors.

The invention further includes a multi-terminal electrical connector comprising: a dielectric housing means; a first row and a second row of terminals accessible at a front side of the housing means and a third row and fourth row of terminals accessible at a rear side of the housing means with the two rows of terminals accessible at each side being laterally spaced with each terminal in one row associated with a laterally spaced terminal in the other row to provide a pair of terminals; a plurality of pairs of electrical conductors extending through the housing means, each pair of conductors connecting an individual one of a pair of terminals on the front side of the housing means with an individual one of a pair of terminals on the rear side of the housing means with one of the conductors in each pair connecting terminals in the first and third rows and the other conductor connecting terminals in the second and fourth rows; a spacer locatable at the rear side of the housing means to separate untwisted conductor wire end portions of a pair of exteriorly positioned twisted together insulated conductor wires for connection of the wire end portions to terminals of a pair in the first and second rows; and means to enable untwisted wire end portions of alternate twisted pairs to crossover each other in a lateral direction of the rows of terminals as the end portions extend beyond the spacer and towards the first and second rows of terminals.

Embodiments of the invention will now be described, by way of example, with reference to the accompanying drawings, in which.

Figure 1:
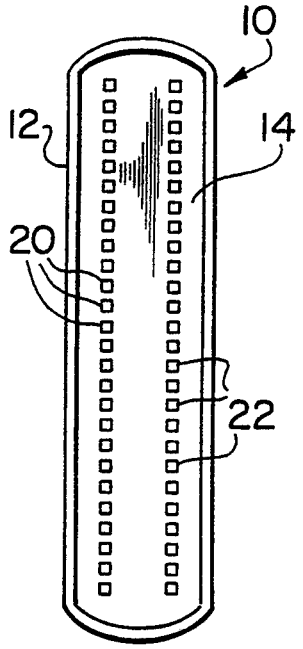
FIG. 1 is a view on a rear side of a housing of a conventional multi-terminal electrical connector.
Figure 2:
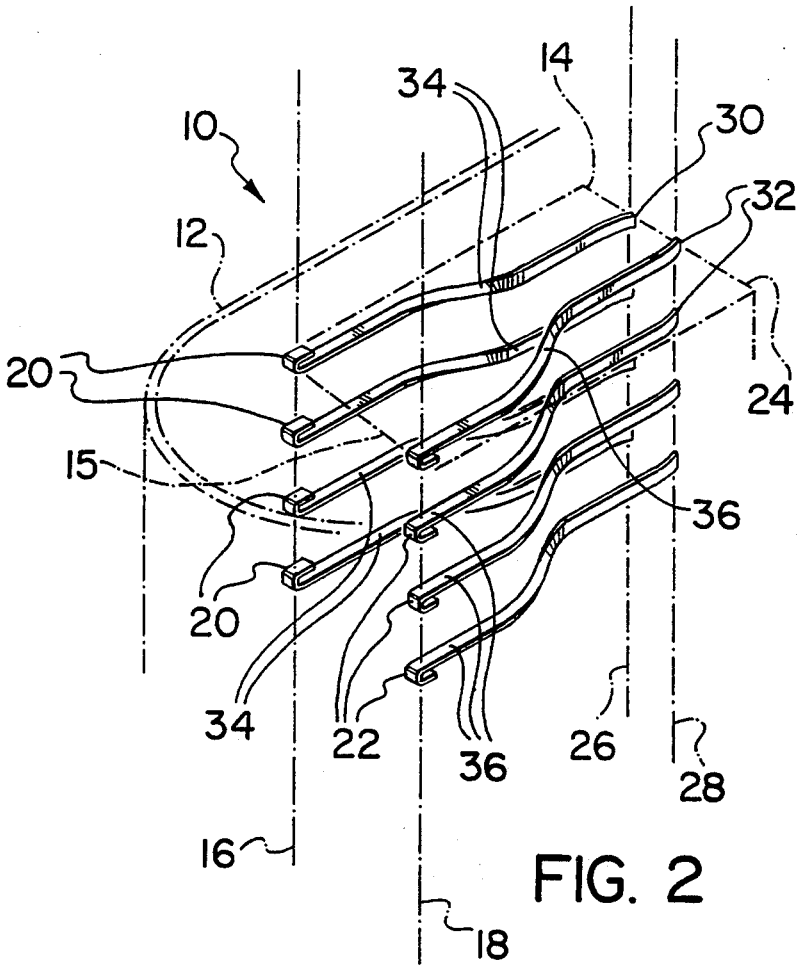
FIG. 2 is a diagrammatic isometric view showing rows of terminals in the housing of the connector of FIG. 1 with conductors extending between the terminals.
Figure 2A:
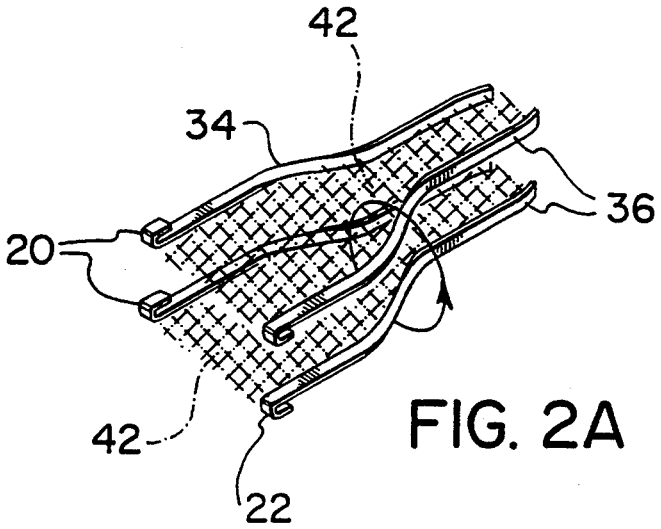
FIG. 2A is a view similar to FIG. 2 of part of the connector of FIG. 1.

As shown by FIG. 1, in a conventional multi-terminal electrical connector 10, a metal housing 12 (FIG. 2 in chain-dotted outline) extends around a dielectric housing means, i.e. a housing 14, also in chain dot. On a rear side 15 of the housing are provided two rows 16 and 18 of electrical terminals 20 and 22. On the front side 24 of the housing 14 there are two other rows of terminals namely rows 26 and 28 as shown by FIG. 2, the row 26 comprising terminals 30 and the row 28 comprising terminals 32. Each terminal 30 is laterally aligned with a terminal 32 to form a pair of terminals and each terminal 20 is laterally aligned with a terminal 22 as shown in FIG. 2A also to form a pair of terminals. Each pair of terminals on one side of the housing 14 is aligned through the housing with a pair of terminals on the other side as may be seen from FIG. 2. Pairs of conductors extend through the housing to contact terminals together. More precisely in each pair of terminals 20, 22, terminal 20 is connected by a conductor 34 of a conductor pair through the housing with a terminal 30 of a terminal pair on the other side of the housing and the conductor 36 of the conductor pair connects the terminal 22 with terminal 32. These connections are made with the conductors 34 and 36 spaced apart laterally of the rows of terminals as they pass through the housing 14. The terminals 20 and 22 of each pair are each connected to an individual conductor wire 38 and 40 of a twisted pair of conductors as shown diagrammatically in FIG. 2, the twisted pairs being held together in the form of a cable as they emerge from the connector.

In use, the connector 10 is electrically connected to a mating connector of similar construction, the mating connector also having conductors placed similarly to the conductors 34 and 36 to connect terminals of pairs on one side of the connector to terminals of pairs on the other side.

A problem which exists with the conventional connector 10 is that due to an electromagnetic coupling effect there is a cross-talk deterioration in transmission at high frequencies as the signal passes between twisted conductor pairs and extending into one connector and twisted pairs 38 and 40 emerging from the other.

This cross-talk degradation increases with increase in frequency and is particularly significant for data communications at frequencies of 10 MHz. It is believed that the electromagnetic coupling is produced as follows. As may be seen from FIG. 2A, each pair of conductors 34 and 36 borders opposite sides of an area 42 which is shown cross-hatched in the figure for convenience. For equal and opposite currents flowing in each conductor 34 and 36, a current loop is formed which may be considered as the primary winding of an effective transformer. The area of the loop times the magnitude of the current defines the magnetic flux. A portion of the magnetic flux is coupled to other loops formed from adjacent pairs of conductors 34 and 36 and which are located directly below or directly above the primary winding. These further loops may be considered as the secondary windings of the effective transformer.

The rate change in the magnetic flux which links the secondary winding to the primary winding induces a voltage i.e. the cross-talk signal. In accordance with Faraday's law, the magnitude of the cross-talk signal is greatest for adjacent loops and is less significant for loops separated by one or more intervening conductors. The cross-talk signal is proportional to an area 42 bounded by the conductors 34 and 36 and is inversely proportional to the distance separating the loops, i.e. the distance between the conductors along the rows 16, 18, 26, 28. This cross-talk signal thus arises from the geometry of the connector with the relative positioning of the terminals and the relative positioning of the conductors 34 and 36. The cross-talk signal is additive to the cross-talk already present within the cable. As a result of the relative positions of the terminals and conductors in this conventional type of connector, the cross-talk produced in the connector (which may be around 1 inch in length between front and rear sides) may exceed the cross-talk within 300 feet of high performance cable at frequencies of 10 MHz and higher. The degree of cross-talk becomes more noticeable when, as is always the case, the connector 10 is connected to a mating connector with its conductors similarly arranged to the conductors 34 and 36.

The following two embodiments of the invention relate to connector structures which minimize the cross-talk which is generated by a multi-terminal electrical connector.

As shown in a first embodiment in FIG. 3, a connector assembly comprises a conventional connector 10 described with reference to FIGS. 1 and 2 above and another conventional connector 50 which is normally a mating connector for the connector 10. Thus, in the connector 10, the terminals 30 and 32 are designed to mate with terminals 52 and 54 at the front side of the connector 50 and extending along rows 56 and 58.

Figure 3:
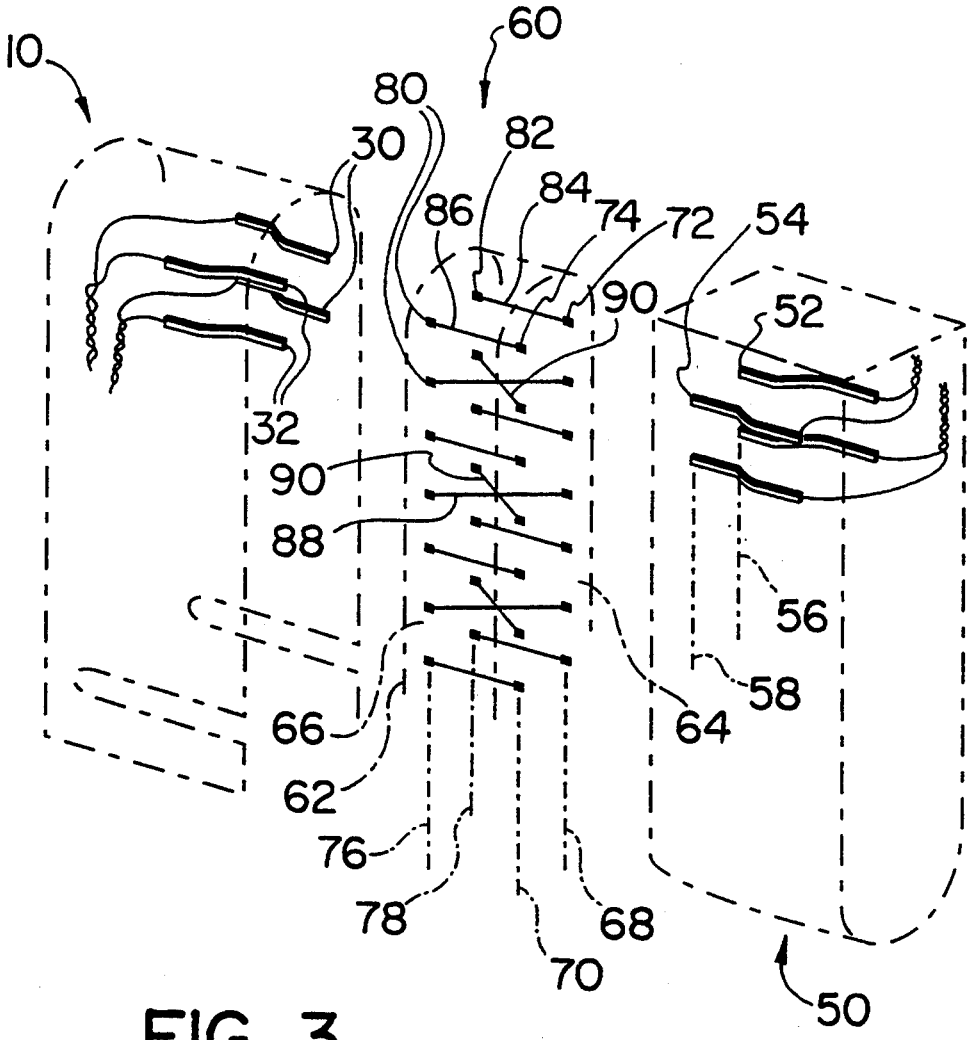
FIG. 3 is a diagrammatic isometric exploded view of an assembly of two conventional connectors having a coupling connector according to a first embodiment disposed between them.

The connector assembly of FIG. 3 differs from a conventional assembly in that a further connector 60 embodying the invention is disposed between the rows of terminals 26, 28 and 56, 58. As may be seen from FIG. 3, the connector 60 comprises a dielectric housing 62 having two sides 64 and 66. At the side 64 are disposed two rows 68 and 70 of terminals 72 and 74. These are terminals for mating connection with the terminals 52 and 54 of the connector 50 with each terminal 72 receiving a terminal 52 and each terminal 74 receiving a terminal 54. At the other side 66 of the dielectric housing 62 are disposed two rows 76 and 78 of terminals 80 and 82 with the terminals 80 for mating with the terminals 32 of the connector 10 and the terminals 82 for mating with the terminals 30.

Alternate terminals 72 in the row 68 are connected to alternate terminals 82 in the row 78 by conductors 84 while the terminals 74 associated with and forming terminal pairs with these terminals 72 are connected by conductors 86 with corresponding terminals 80 as is shown diagrammatically in FIG. 3. In each of the other pairs of terminals the terminals 72 are connected to terminals 80 by a conductor 88 while the terminals 74 are connected to a terminal 82 by conductor 90. As a result, and as may be seen from FIG. 3 the conductors 88 and 90 extend laterally of the rows of terminals so as to cross-over each other as they extend from the side 64 to the side 66.

Figure 4:
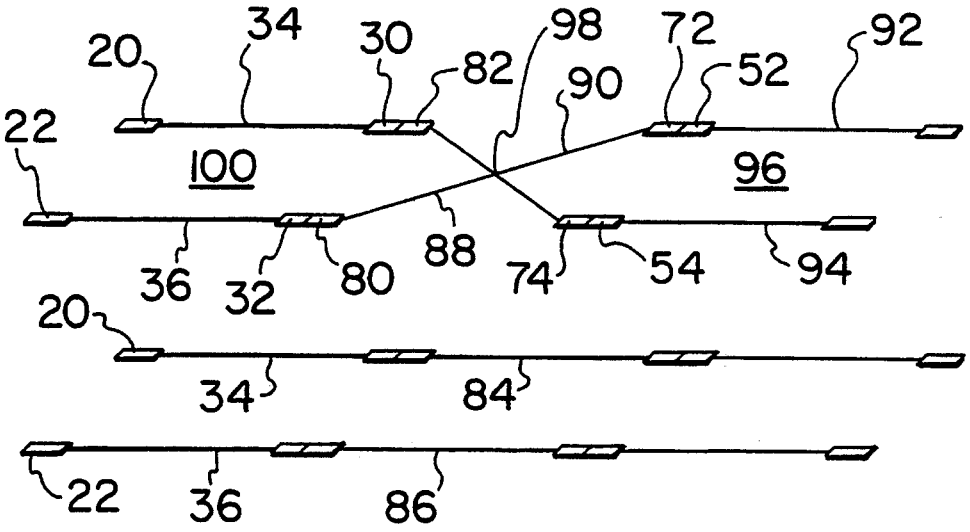
FIG. 4 is a view showing part of conductor pathways through the assembly of FIG. 3.

In practice, as may be seen from FIG. 4, it is considered that primary windings of an effective transformer are produced through the electrical pathways associated with the conductors 84 and 86. Secondary windings will be provided by the immediately adjacent pathways through and associated with the cross-over conductors 88 and 90. Because of the crossover of the conductors 88 and 90, then the area 96 which is bounded at its sides by the conductors 92 and 94 and the conductors 88 and 90 as far as the crossover position 98 is substantially equal to the area 100 bounded by the remainder of the conductors 88 and 90 and the conductors 34 and 36. If the voltage induced in the secondary winding is positive in the section associated with the area 96, then it is negative in the section associated with the area 100. As a result if the areas 96 and 100 are substantially equal then the cross-talk through the connector assembly of connectors 10, 50 and 60 is effectively reduced to zero. The slight differences in the areas 96 and 100 will produce negligible cross-talk.

As may be seen from the first embodiment, the connector 60, which substantially permits elimination of cross-talk in the connector assembly, may be inserted into an established assembly of connectors 10 and 50 (which are already operational) merely by disconnecting the connectors 10 and 50 and inserting connector 60 between them. Thus, a substantial amount of cross-talk previously produced in connectors 10 and 50 may be minimized fairly easily by the use of the connector 60.

Figure 5:
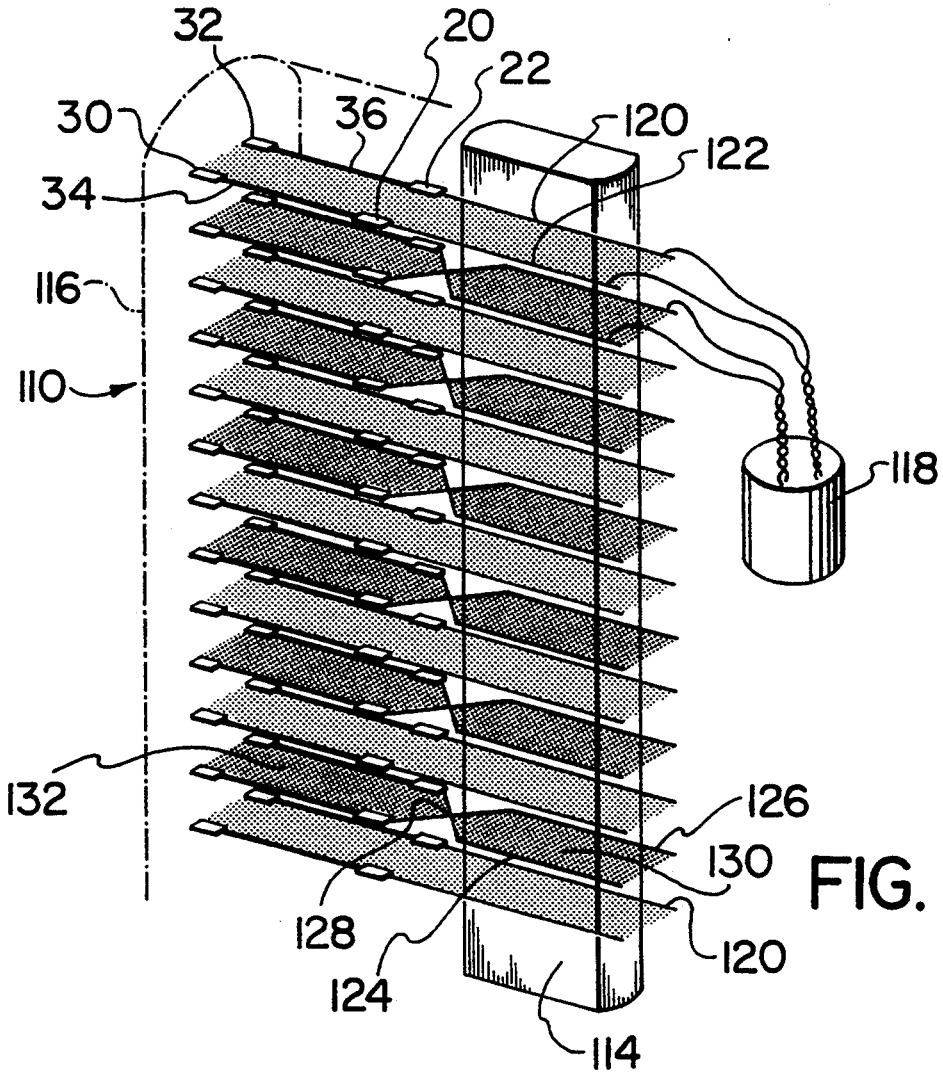
FIG. 5 is a diagrammatic isometric view of a connector according to a second embodiment.

In a second embodiment as shown in FIG. 5, a connector 110 is of similar construction to the conventional connector 10 described above while having the housing 12 (not shown) of the connector extending further beyond the rear side of the connector than is normally required for a conventional connector. The reason for this is that in the connector 110 there is provided a spacer which is a planar dielectric guide member 114 which extends outwardly from the rear side of the dielectric body 116 of the connector 10 to control the positions of end portions of insulated conductor wires extending to the terminals 20 and 22 along the lines of terminals 16 and 18. The guide 114 is disposed in a fixed position extending outwardly from the rear side of the dielectric body 116 while providing a means to enable untwisted wire end portions to crossover between the guide and the rear of the dielectric body 116. The guide 114 is located in position by a registration means (not shown) which forms a gap between the rear of the dielectric housing 116 and the guide 114, the gap forming the crossover enabling means. As a result, when the conductor wires of an incoming cable 118 are connected to the connector 110 then wires 120 and 122 forming alternate twisted pairs may be untwisted sufficiently to extend on either side of the guide 114 and then to extend further in substantially parallel and untwisted relationship to respective terminals 20 and 22 forming a pair of terminals in the two rows. The other pairs of conductor wires 124 and 126 are also untwisted at their end portions to enable them to pass at either side of the guide 114. However, these particular conductor wires 124, 126 are caused to crossover each other by passing them through the gap formed between the dielectric housing 116 and the guide 114 at positions 128 as shown in FIG. 5. As a result the conductor wires 126 at one side of the guide 114 are connected to the terminal 22 of the row 18 at the other side of the housing 116 and the conductor wires 124 are similarly connected to the terminals 20.

As may be seen from the above wiring arrangement which is made possible by the relative positions of the guide 114 and of the housing 116 to provide the necessary gap, the crossover positions 128 for the wires 124, 126 cause two areas 130 and 132 at each side of the crossover points the area 130 defined by the conductor wires 124 and 126 and the area 132 defined by the conductors 34 and 36. The secondary windings related to these areas 130 and 132 produce a positively flowing current associated with one of the areas and a negatively flowing current associated with the other of the areas which act upon the primary windings associated with the conductor wires 120 and 122 to reduce the cross-talk. In the connector, if the guide 114 is designed of suitable size, then the areas 130 and 132 are substantially equal so as to effectively cancel the cross-talk which would otherwise be generated by the connector 110.

In a third embodiment (not shown) and with reference to the first embodiment, the further connector 60 is not used. Each of the connectors 10 is provided with conductors in alternate pairs which cross-over each other in a manner similar to those of the connector 60.

What is claimed is:

1. A multi-terminal electrical connector and wire combination in which the connector comprises:

a dielectric housing means;

a first row and a second row of terminals accessible at a front side of the housing means and a third row and a fourth row of terminals accessible at a rear side of the housing means with the two rows of terminals accessible at each side being laterally spaced with each terminal in one row associated with a laterally spaced terminal in the other row to provide a pair of terminals;

a plurality of pairs of electrical conductors extending through the housing means each pair of conductors connecting an individual one of a pair of terminals on the front side of the housing means with an individual one of a pair of terminals on the rear side of the hosing means, one of the conductors in each pair connecting terminals in the first and third rows and the other conductor in each pair connecting terminals in the second and fourth rows;

and an elongate spacer located at the rear side of the housing means for spacing wires, the elongate spacer extending in the direction of the rows of terminals;

and the wires include a plurality of pairs of wires connected to the third and fourth rows of terminals, the wires in each oak being twisted together exteriorly of the connector and having untwisted end portions which extend one on each side of and are separated by the spacer with first wires of the pairs on one side of the spacer and second wires of the pairs on the other side of the spacer, and in which wires in alternate pairs crossover each other between the spacer and the terminals with the first wires of the alternate pairs connected to terminals of the fourth row and the second wires of the alternate pairs connected to terminals in the third row, and in the other pairs of wires, the first wires are connected to terminals in the third row and the second wires are corrected to terminals in the fourth row.

* * * * *